US007281978B2

(12) United States Patent
Moshal

(10) Patent No.: US 7,281,978 B2
(45) Date of Patent: Oct. 16, 2007

(54) WAGER ADMINISTRATION SYSTEM AND METHOD OF OPERATION THEREOF

(75) Inventor: Martin Moshal, Marina Bay (GI)

(73) Assignee: Waterleaf Limited, Douglas, Isle of Man (GB)

( * ) Notice: Subject to any disclaimer, the term of this patent is extended or adjusted under 35 U.S.C. 154(b) by 75 days.

(21) Appl. No.: 10/504,305

(22) PCT Filed: Feb. 13, 2003

(86) PCT No.: PCT/IB03/00462

§ 371 (c)(1),
(2), (4) Date: Apr. 29, 2005

(87) PCT Pub. No.: WO03/068343

PCT Pub. Date: Aug. 21, 2003

(65) Prior Publication Data

US 2005/0239535 A1 Oct. 27, 2005

(30) Foreign Application Priority Data

Feb. 14, 2002 (GB) ..... 0203518.6

(51) Int. Cl.
*A63F 5/00* (2006.01)

(52) U.S. Cl. ..... 463/17; 273/274; 273/142

(58) Field of Classification Search ..... 273/274, 273/292, 142; 463/17, 21, 22
See application file for complete search history.

(56) References Cited

U.S. PATENT DOCUMENTS 3,189,186 A * 6/1965 Palant ..... 224/558
4,321,673 A * 3/1982 Hawwass et al. ..... 463/22
4,339,798 A * 7/1982 Hedges et al. ..... 463/26
4,467,424 A * 8/1984 Hedges et al. ..... 463/26
5,588,650 A * 12/1996 Eman et al. ..... 273/142 B
5,775,993 A 7/1998 Fentz et al.
5,800,268 A * 9/1998 Molnick ..... 463/40

(Continued)

FOREIGN PATENT DOCUMENTS

WO WO 03/026754 A1 4/2003

*Primary Examiner*—William M. Pierce
(74) *Attorney, Agent, or Firm*—McDonnell Boehnen Hulbert & Berghoff LLP

(57) ABSTRACT a wager administration system comprises a primary wagering facility operable by a player to place an initial wager on a desired primary individual number in a turn of the game of roulette, and a secondary wagering facility instructable by the player to place an additional wager on an individual number adjacent the primary individual number on a layout of a roulette wheel. The secondary wagering facility is also instructable by the player to place additional wagers on each on of 2, 3, 4, 5, 6, 7, 8, 9, 10, 11, 13, 14, 15 or 16 individual numbers, selectively, located closest to the primary individual number and circumferentially to one side of thereof on a layout of a roulette wheel. The secondary wagering facility is still further instructable by the player to place additional wagers on each one of a pair of individual numbers adjacent the primary individual number and on both sides thereof on a layout of a roulette wheel, or to place additional wagers on each of 2, 3, 4, 5, 6, 7, 8, 9, 10, 11, 13, 14, 15 or 16 pairs of individual numbers, selectively, located closest to the primary individual number and circumferentially on both sides thereof on a layout of a roulette wheel. Each additional wager is the same size as the initial wager.

33 Claims, 6 Drawing Sheets

U.S. PATENT DOCUMENTS 5,857,909 A * 1/1999 Rubin ..... 463/17
6,572,474 B2 * 6/2003 Rudd ..... 463/25
6,575,834 B1 6/2003 Lindo
6,659,866 B2 * 12/2003 Frost et al. ..... 463/17

* cited by examiner

WAGER ADMINISTRATION SYSTEM AND METHOD OF OPERATION THEREOF

FIELD OF THE INVENTION

This invention relates to a wager administration system and, more particularly, to a wager administration system that can be employed to administer wagers to be placed by a player on a turn of a game of roulette. The invention extends to method of administering wagers to be placed by a player on a turn of the game of roulette.

BACKGROUND TO THE INVENTION

One of the most well known and widely played casino games is that of roulette, which is played at most land-based and on-line casinos.

At the simplest level, in a conventional game of roulette, a player may place a wager associated with any one or more of 37 locations on a playing surface. The locations on the playing surface are laid out in a standard configuration, which is well known in the art and requires no further elaboration. A number in the range 0 to 36 uniquely identifies each location on the playing surface, and each location has a corresponding colour that is red, black or green. The outcome of the game is determined by a spin of a ball against a rotating roulette wheel having 37 pockets in which the ball may come to rest, each pocket being uniquely identified by a number in the range 0 to 36, respectively. This version of the game is known in the art as "European" roulette. The pockets are arranged circumferentially on the roulette wheel in a standard configuration.

A variant of the game of roulette is the so-called "American" roulette and is one in which the playing surface has 38 locations and the roulette wheel has 38 pockets, each location and pocket being identified uniquely by a number in the range 0 to 36, as well as the "number" 00.

In the description that follows, the invention will be described with particular reference to the European version of the roulette game. It is to be clearly understood, however, that the invention is also applicable to the American version of the game.

If the ball comes to rest in a pocket corresponding to a location on the playing surface on which the player has placed a wager, the player is paid an amount of 35 times the amount of the wager. The player forfeits all other wagers of this type on the playing surface to an operator of the roulette game.

Additional types of wagers are allowed on the playing surface, such as a wager on any two, three, four or six adjacent locations thereon, a wager on any one of locations 1 to 12, 13 to 24, or 25 to 36, a wager on any one of the numbers in any column arrangement on the playing surface, a wager on any even or any odd number, a wager on any red location or any black location, or a wager on any one of locations 1 to 18, or 19 to 36. The payout on successful wagers of these types is determined to give an appropriate advantage to the operator of the roulette game.

In the light of the large number and variety of different types of wagers that are possible in the game of roulette, it is customary for a player to place numerous different wagers on a turn of the game of roulette. After the outcome of the spin of the roulette wheel is known, each one of the different wagers must be individually evaluated and paid, if successful. This can be tedious, particularly when the game is played in a land-based casino.

An even greater problem is the time required by a player to place a large number of different wagers on the playing surface prior to a spin of the roulette wheel, an activity which can be laborious and can cause the player's interest in the game to wane rapidly. The problem is exacerbated for players who place multiple wagers on the playing surface according to a system, or in a set pattern, prior to each spin of the roulette wheel, or as a function of the outcome of previous wagers, which can be tedious.

OBJECT OF THE INVENTION

It is an object of this invention to provide a wager administration system and a method of administering wagers that will, at least partially, alleviate the above-mentioned difficulties and disadvantages.

SUMMARY OF THE INVENTION

In accordance with this invention there is provided a wager administration system, comprising:

a primary wagering facility operable to place an initial wager on a desired primary individual number in a turn of the game of roulette; and a secondary wagering facility instructable to place an additional wager on an individual number adjacent the primary individual number on a layout of a roulette wheel.

Further features of the invention provide for the secondary wagering facility to be instructable to place additional wagers on each one of 2, 3, 4, 5, 6, 7, 8, 9, 10, 11, 13, 14, 15 or 16 individual numbers, selectively, located closest to the primary individual number and circumferentially to one side of thereof on a layout of a roulette wheel, for the secondary wagering facility to be instructable to place additional wagers on each one of a pair of individual numbers adjacent the primary individual number and on both sides thereof on a layout of a roulette wheel, and for the secondary wagering facility to be instructable to place additional wagers on each of 2, 3, 4, 5, 6, 7, 8, 9, 10, 11, 13, 14, 15 or 16 pairs of individual numbers, selectively, located closest to the primary individual number and circumferentially on both sides thereof on a layout of a roulette wheel.

Still further features of the invention provide for each additional wager to be the same size as the initial wager.

As shown in FIGS. 2-4, the invention extends to a method of administering wagers, comprising the steps of:

operating a primary wagering facility to place an initial wager on a desired primary individual number in a turn of the game of roulette (block 200); and instructing a secondary wagering facility to place an additional wager on an individual number adjacent the primary individual number on a layout of a roulette wheel (block 202).

There is further provided for instructing the secondary wagering facility to place additional wagers on each one of 2, 3, 4, 5, 6, 7, 8, 9, 10, 11, 13, 14, 15 or 16 individual numbers, selectively, located closest to the primary individual number and circumferentially on one side of thereof on a layout of a roulette wheel (block 204), for instructing the secondary wagering facility to place additional wagers on each one of a pair of individual numbers adjacent the primary individual number and on both sides thereof on a layout of a roulette wheel(block 206), and for instructing the secondary wagering facility to place additional wagers on each of 2, 3, 4, 5, 6, 7, 8, 9, 10, 11, 13, 14, 15 or 16 pairs of individual numbers, selectively, located closest to the primary individual number and circumferentially on both sides thereof on a layout of a roulette wheel(block 208).

There is still further provided for placing each additional wager to be the same size as the initial wager.

The invention extends still further to a wagering administration system, comprising:

a display means operable to display a playing surface for a game of roulette 8 (shown in FIG. 1);

a wagering facility operable to construct a wagering template relating to a number of desired wagers to be placed on a turn of the game of roulette; and a storage means instructable to store a wagering data set representative of the wagering template.

There is further provided for the storage means to be instructable to store a plurality of different wagering data sets representative of different wagering templates, for each desired wager in a wagering template to relate to a type of wager to be placed on the playing surface, and a corresponding size of the wager, for the wagering facility to be activatable to submit desired wagers on a subsequent turn of the game of roulette according to any selectable one of the stored wagering data sets, and for the wagering facility to be activatable to submit the wagers on the subsequent turn of the game of roulette by adding the desired wagers to any wagers previously placed on the turn of the game, alternatively by replacing all wagers previously placed on the turn of the game with the desired wagers.

There is still further provided for the display means to also display a layout of a roulette wheel 9 (shown in FIG. 1), for the wagering facility to be operable to automatically construct a wagering template having a desired wager on a selectable primary number on the layout of the roulette wheel and an additional desired wager on a number adjacent the primary number on the layout of the roulette wheel, for the wagering facility to be operable to automatically construct a wagering template having additional desired wagers on each one of 2, 3, 4, 5, 6, 7, 8, 9, 10, 11, 13, 14, 15 or 16 numbers, selectively, located closest to the primary number and circumferentially on one side of thereof on the layout of the roulette wheel, for the wagering facility to be operable to automatically construct a wagering template having additional desired wagers on each one of a pair of individual numbers adjacent the primary number and on both sides thereof on the layout of the roulette wheel, and for the wagering facility to be operable to automatically construct a wagering template having additional desired wagers on each of 2, 3, 4, 5, 6, 7, 8, 9, 10, 11, 13, 14, 15 or 16 pairs of numbers, selectively, located closest to the primary number and circumferentially on both sides thereof on the layout of the roulette wheel.

There is yet further provided for the display means to also display total amounts wagered for each one of a number of different desired wager types in the template, and for the different desired wager types for which the total wagered amounts are displayed to include any one or more of odd numbers, even numbers, black numbers, red numbers, numbers 1 to 12, numbers 13 to 24, numbers 25 to 36, numbers 1 to 18, numbers 19 to 36, the first, second and third columns on the playing surface of the game of roulette, and the total amount of all wagers in the wagering template.

There is also provided for the wagering facility to be operable to amend a stored wagering data set, and for the wagering facility to be operable to also clear all data in a stored wagering data set.

As shown in FIG. 5, the invention extends yet further to a method of administering wagers, comprising the steps of:

displaying a playing surface for a game of roulette ()block 500);

constructing a wagering template relating to a number of desired wagers to be placed on a turn of the game of roulette (block 502); and storing a wagering data set representative of the wagering template (block 504).

There is further provided for storing a plurality of different wagering data sets representative of different wagering templates (block 506), for specifying each desired wager in a wagering template as a type of wager to be placed on the playing surface, and a corresponding size of the wager, for submitting the desired wagers on a subsequent turn of the game of roulette according to any selectable one of the stored wagering data sets, and for submitting the wagers on the subsequent turn of the game of roulette by adding the desired wagers to any wagers previously placed on the turn of the game, alternatively by replacing wagers previously placed on the turn of the game with the desired wagers (block 508).

There is still further provided for also displaying a layout of a roulette wheel, for automatically constructing a wagering template having a desired wager on a selected primary number on the layout of the roulette wheel (block 510) and an additional desired wager on a number adjacent the primary number on the layout of the roulette wheel, for automatically constructing a wagering template having additional desired wagers on each one of 2, 3, 4, 5, 6, 7, 8, 9, 10, 11, 13, 14, 15 or 16 numbers, selectively, located closest to the primary number and circumferentially on one side of thereof on the layout of the roulette wheel (block 512), for automatically constructing a wagering template having additional desired wagers on each one of a pair of individual numbers adjacent the primary number and on both sides thereof on the layout of the roulette wheel (block 514), and, as shown at FIG. 6, for automatically constructing a wagering template having additional desired wagers on each of 2, 3, 4, 5, 6, 7, 8, 9, 10, 11, 13, 14, 15 or 16 pairs of numbers, selectively, located closest to the primary number and circumferentially on both sides thereof on the layout of the roulette wheel (block 516).

There is yet further provided for also displaying total amounts wagered for each one of a number of different desired wager types in any one of the wagering templates, and for the different desired wager types for which the total wagered amounts are displayed to include any one or more of odd numbers, even numbers, black numbers, red numbers, numbers 1 to 12, numbers 13 to 24, numbers 25 to 36, numbers 1 to 18, numbers 19 to 36, the first, second and third columns on the playing surface of the game of roulette, and the total amount of all wagers in the wagering template (block 518).

There is also provided for amending a stored wagering data set (block 520), and for also clearing all data in a stored wagering data set (block 522).

BRIEF DESCRIPTION OF THE DRAWINGS

A preferred embodiment of the invention is described below, by way of example only, and with reference to the accompanying drawings in which.

DETAILED DESCRIPTION OF THE INVENTION

Figure 1:
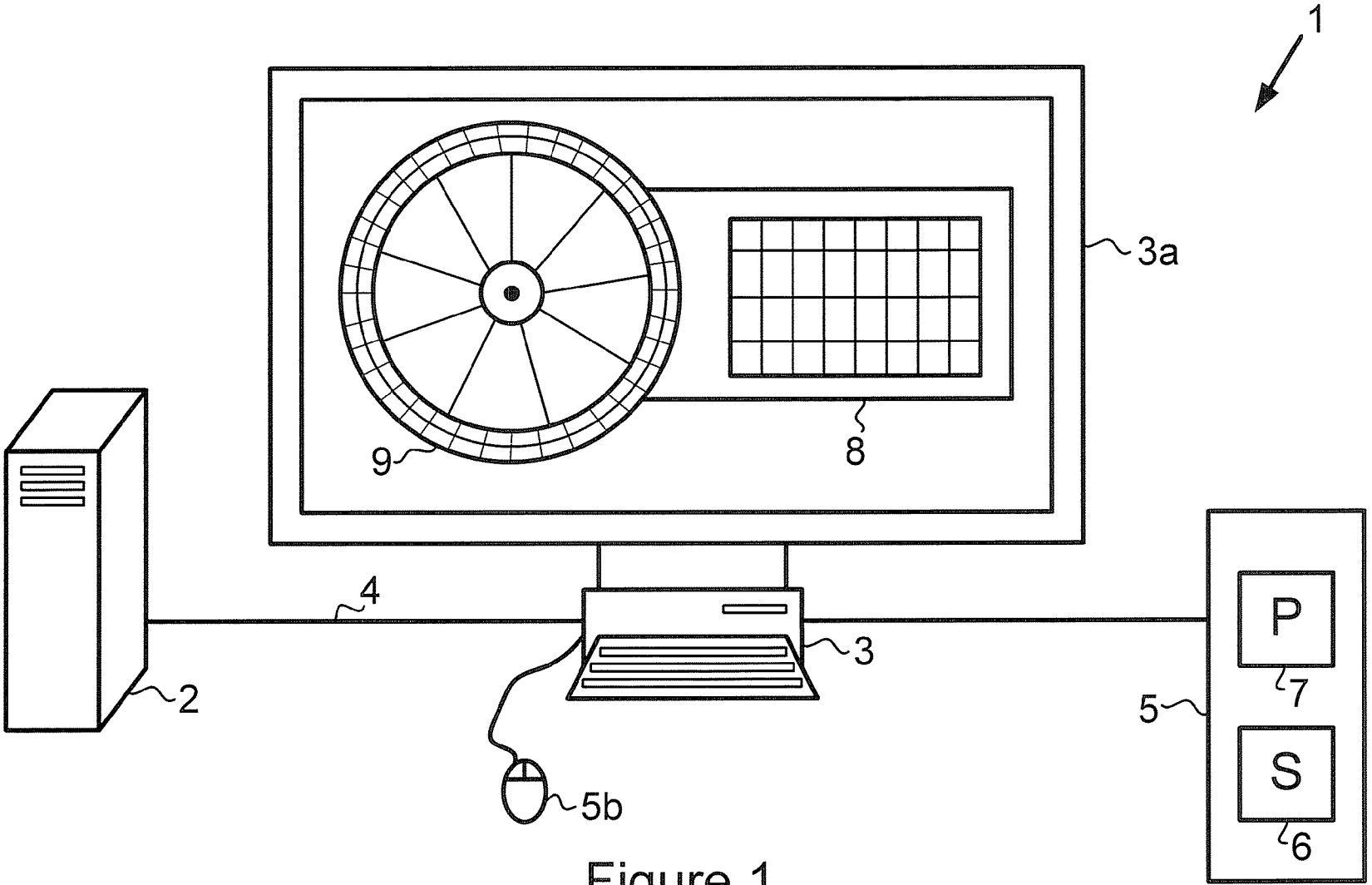
FIG. 1 is a schematic representation of a wagering administration system according to the invention.
Figure 2:
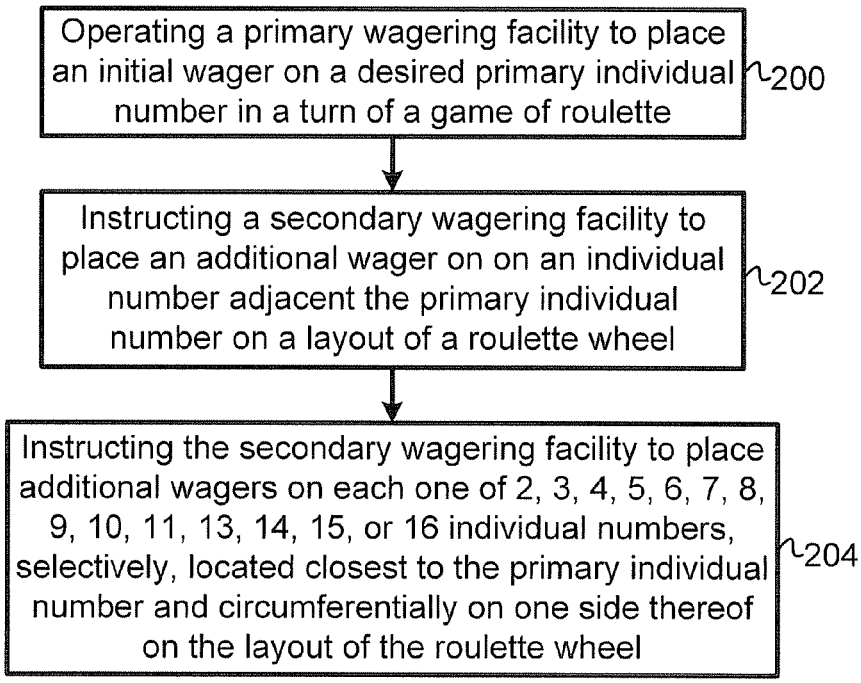
FIGS. 2, 3, and 4 are flow charts each depicting a set of functions that can be carried out in accordance with an exemplary embodiment.
Figure 3:
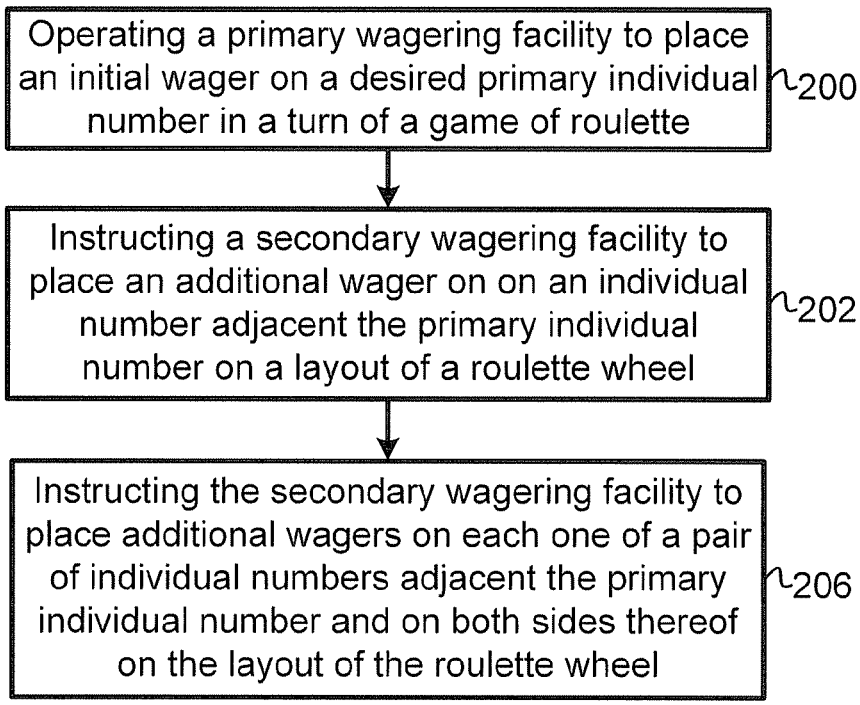
Figure 4:
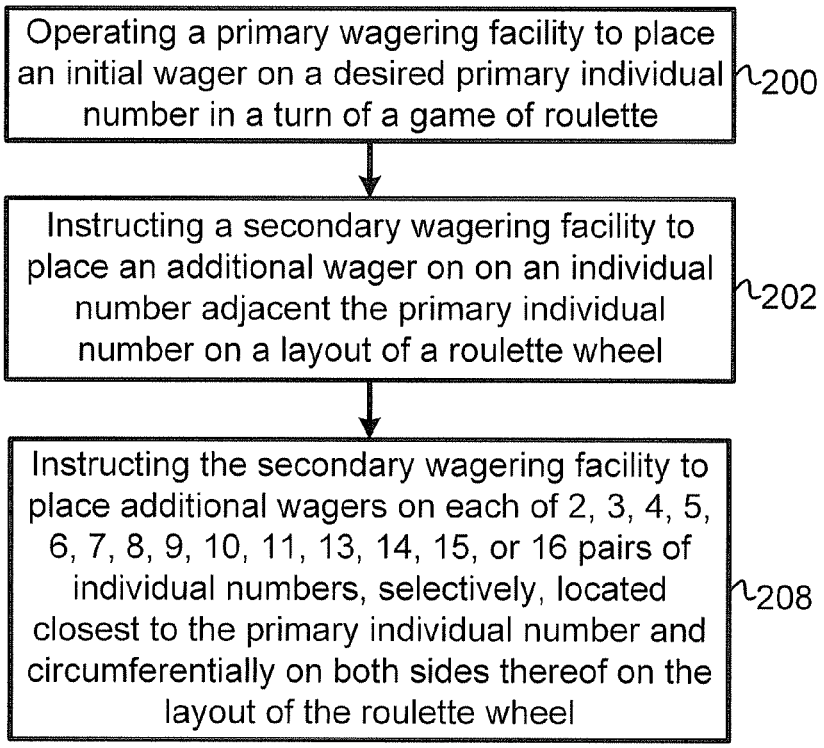
Figure 5:
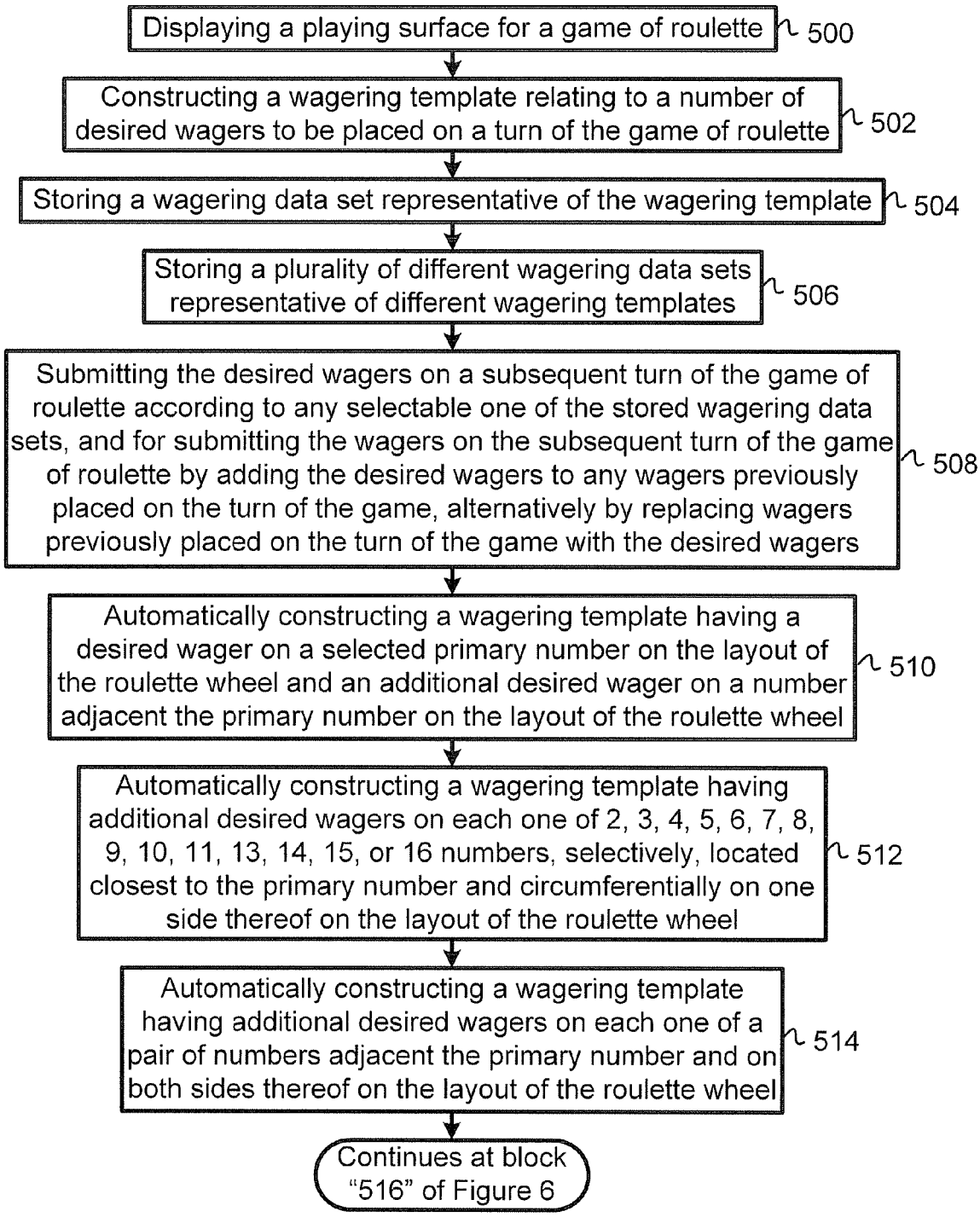
FIGS. 5 and 6 is a flow chart depicting another set of functions that can be carried out in accordance with an exemplary embodiment.
Figure 6:
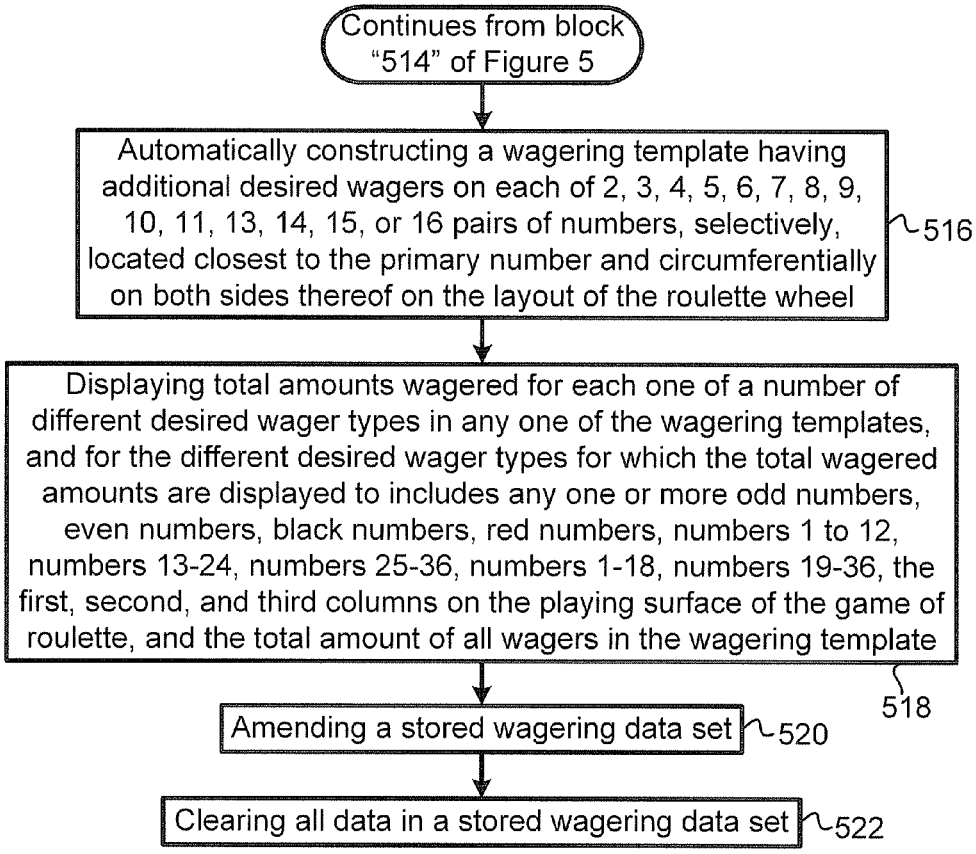

Referring to FIG. 1, a wager administration system is indicated generally by reference numeral (1).

The wager administration system (1) includes a gaming server (2) and a user access facility (3) in the form of a computer workstation with an associated display monitor (3*a*) and a pointing device (5*b*), such as a mouse or, alternatively, a touchpad. The computer workstation (3) is located remotely from the gaming server (2) and communication between the computer workstation and the gaming server is provided across a communication network (4) that is, in this embodiment, the Internet.

The computer workstation (3) is a conventional personal computer operating under a Windows 2000 operating system, which is well known and commercially available from the Microsoft Corporation of Seattle, Wash., US. The gaming server (2) also operates under the Windows 2000 operating system. The computer workstation (3) executes a stored program (5), the operation of which will be outlined in the description that follows. The stored program (5) in the computer workstation displays to a user of the system (1) a conventional playing surface on which a game of roulette is played, as well as a layout of a conventional roulette wheel (not shown).

During a turn of the game of roulette, the stored program (5) in the computer workstation (3) provides the user with a primary wagering facility (6) that enables the user to place one or more wagers on the turn of the game. Once the user has placed the initial wagers in this manner, the computer workstation (3) instructs the gaming server (2) to simulate a spin of the roulette wheel. The spin of the roulette wheel is implemented as a software random number generator that is executed in the gaming server (2), which generates a random number in the range 0 to 36. The gaming server (2) then transmits the generated random number to the computer workstation (3) along the communication network (4). The stored program in the computer workstation (3) displays the generated random number to the user by means of an animated sequence in which a ball is displayed as spinning around the periphery of the roulette wheel, which is counter-rotating, and coming to rest in a pocket on the layout of the roulette wheel that corresponds to the generated random number. The generated random number is also indicated on the displayed playing surface in a configuration similar to that used on a conventional roulette table.

The primary wagering facility (6) enables the user to place different types of wagers on a turn of the game, which can be any one or more of: a wager on a particular number on the playing surface, a wager on any particular two, three, four or six adjacent numbers on the displayed playing surface, a wager on any odd number, any even number, any black number, any red number, any number from 1 to 12, from 13 to 24, from 25 to 36, any number from 1 to 18, or from 19 to 36, and any number grouped in a first, second and third column, respectively, on the displayed playing surface of the game of roulette.

Once the user has made all the wagers which he desires to make, game then progresses in a conventional manner in which the spin of the roulette wheel is simulated and the generated random number displayed, and the outcome of the various wagers is determined by the stored program in the gaming server (2), according to conventional rules of the game of roulette. Successful wagers are paid at predetermined odds and all unsuccessful wagers are forfeited to an operator of the roulette game, as described above.

In order to facilitate the placement of wagers by the user, the stored program (5) in the computer workstation (3) also has a secondary wagering facility (7) that is instructable by the user to automatically place certain additional wagers on the same turn of the game, subsequent to placement of an the initial wager by the user on a selected individual number on the playing surface. The corresponding additional wagers are automatically placed by means of the secondary wagering facility (7) with minimal intervention required by the user.

The secondary wagering facility (7) consists of a secondary wagering icon (not shown) that is displayed to the user, and a configuration facility. Once the user has placed a wager on a desired primary individual number on the displayed playing surface on the next turn of the game, activation of the secondary wagering icon causes additional wagers to be placed automatically on the turn of the game, as follows:

1. the selected primary individual number is taken as a point of reference on the displayed layout of the roulette wheel;
2. additional wagers are placed automatically on two additional individual numbers ("the neighbouring pair") adjacent to, and on either side of, the primary individual number on the layout of the roulette wheel;
3. the size of each additional wager is the same magnitude as that of the wager on the desired primary individual number;
4. the user may configure the functionality of the secondary wagering icon to cause additional wagers to be placed automatically on each of 2, 3, 4, 5, 6, 7, 8, 9, 10, 11, 12, 13, 14, 15 or 16 neighbouring pairs of individual numbers, selectively, closest to the primary individual number and on either side thereof on the layout of the roulette wheel.

It will be appreciated by those skilled in the art that the wager administration system described above enables a user to more easily place wagers to cover the numbers in a desired sector of a standard roulette wheel for a turn of the game of roulette than by placing such wagers individually on those same numbers. The individual numbers appear on the playing surface in numerical sequence, and covering the desired sector of the roulette wheel with wagers by placing separate wagers on the corresponding individual numbers on the playing surface is tedious and time consuming. It is anticipated that such a "sector wager facility" will increase a rate at which successive turns of the game will be played, and help to retain the user's interest in the game over an extended period.

Numerous modifications are possible to this embodiment without departing from the scope of the invention. In particular, the operation of the secondary wagering facility (7) may be such that activation of the secondary wagering icon enables the user to make additional wagers on the closest neighbouring numbers as described above, but which are located only on one side of the selected primary individual number, either in a clockwise or an anti-clockwise direction, respectively, on the layout of the roulette wheel.

The secondary wagering facility (7) described above, while enabling a user to easily cover a desired portion of the playing surface with wagers for a turn of the game of roulette, provides little assistance to a user where the desired coverage of the playing surface does not coincide with the numbers extending over a sector of the roulette wheel, or where wagers other than wagers on individual numbers are to be made.

In order to overcome this difficulty, the stored program (5) in the computer workstation (3) also enables the user to construct a wagering template relating to a number of desired wagers to be placed on a turn of the game of roulette. The computer workstation (3) also includes a storage means in the form of a local storage device (not shown) that is instructable to store a wagering data set representative of the wagering template.

In use, the user is able to construct one or more predefined wagering templates, each template defining a layout of a number of desired wagers to be placed on a turn of the game, and the storage device is instructable to store a wagering data set corresponding to each one or more of the wagering templates constructed by the user. Each desired wager in a wagering template defines the type of wager to be placed on the playing surface of the game of roulette, and a corresponding size of the wager. The user is also able to amend an existing wagering template and its corresponding stored wagering data set, or to clear all wagers in an existing wagering template in order to recreate the wagering template from scratch.

The wager administration system (1) can be activated by the user to submit the wagers defined in any desired one of the predefined wagering templates on a subsequent turn of the game of roulette. At the discretion of the user, the wagers in such a wagering template can added to any existing wagers previously placed on the turn of the game or, alternatively, by replacing all wagers previously placed on the turn of the game with the desired wagers as defined in the wagering template.

In constructing such a wagering template, the user may also utilise the "closest neighbours" wagering facility described above to provide a simple and rapid coverage of a desired portion of the playing surface with single-number wagers. For convenience, the description of the "closest neighbours" wagering facility will not be repeated here. During the construction of a wagering template, the stored program (5) on the computer workstation (3) also displays, as part of the template, statistics showing a running total of an amount wagered for each one of the different possible wager types on the template. This will provide an overview of the coverage of the playing surface and allow the user to assess where his wagers lie and to analyse the coverage.

It will be appreciated by those skilled in the art that the ability to construct and to store predefined wagering templates will be advantageous to all players, particularly players who place wagers on the game of roulette according to a system. It overcomes the tedium and frustration associated with placing a large number of identical or closely identical wagers on repeated turns of the game. It is anticipated that this facility will provide a fast-paced and exciting game of roulette and will assist in retaining the user's interest in the game over an extended period of time.

The technical problem solved by this invention is that of speeding up the progress of consecutive turns of a game of roulette. This effect is obtained by automating the placement of wagers on any turn of the game. The automation is achieved through the use of either one or both of preconfigurable wagering templates and the placement of one or more sector wagers on the roulette wheel.

Numerous modifications are possible to this embodiment without departing from the scope of the invention. In particular, the stored program (5) that provides the primary (6) and secondary (7) wagering facilities may be executed in the gaming server (2) instead of in the computer workstation (3). Further, the wager administration system (1) can be applied to a game of roulette in self-contained apparata that do not operate in an online environment, such as electronic gaming devices of the type commonly found in land-based casinos, or handheld gaming devices.

Further, the storage device that is instructable to store the wagering data set representative of the wagering template may be located on the gaming server (2) instead of in the computer workstation (3).

The invention therefore provides a novel wagering system and a method of operation thereof that enables a user to place wagers on a fast-paced game of roulette in an on-line environment.

The invention claimed is:

1. Apparatus comprising:

a gaming server programmed to regulate a game of roulette;

a player access facility remote from the gaming server, the player access facility being programmed to display a simulation of a roulette wheel in the game of roulette and to provide an interface that includes a primary element and a secondary element, wherein the primary element enables a player of the game of roulette to place an initial wager on a primary number in a turn of the game and the secondary element enables the player to automatically place at least one additional wager on at least one additional number in the turn of the game, wherein the at least one additional number is based on a location of the primary number on a layout of the roulette wheel; and a communication network providing communication between the gaming server and the player access facility.

2. Apparatus as claimed in claim 1 in which the secondary element enables the player to place additional wagers on each one of 2, 3, 4, 5, 6, 7, 8, 9, 10, 11, 12, 13, 14, 15 or 16 numbers, selectively, located closest to the primary number and circumferentially to one side thereof on the layout of the roulette wheel.

3. Apparatus as claimed in claim 1 in which the secondary element enables the player to place additional wagers on each one of a pair of numbers adjacent the primary number and on both sides thereof on the layout of the roulette wheel.

4. Apparatus as claimed in claim 1 in which the secondary element enables the player to place additional wagers on each of 2, 3, 4, 5, 6, 7, 8, 9, 10, 11, 12, 13, 14, 15 or 16 pairs of numbers, selectively, located closest to the primary number and circumferentially on both sides thereof on the layout of the roulette wheel.

5. Apparatus as claimed in claim 1 in which each additional wager is the same size as the initial wager.

6. Apparatus comprising:

a gaming server programmed to regulate a game of roulette;

a player access facility remote from the gaming server, the player access facility being programmed to display a simulation of a roulette wheel in the game of roulette and to enable a player to construct at least one player-defined wagering template relating to a number of desired wagers to be placed on a turn of the game of roulette and store a wagering data set representative of the at least one wagering template; and a communication network providing communication between the gaming server and the player access facility.

7. Apparatus as claimed in claim 6 in which the player access facility enables the player to store a plurality of different wagering data sets representative of different player-defined wagering templates, respectively.

8. Apparatus as claimed in claim 6 in which each desired wager in the at least one player-defined wagering template relates to a type of wager to be placed on the turn of the game of roulette, and a corresponding size of the wager.

9. Apparatus as claimed in claim 8 in which the player access facility enables the player to submit desired wagers on a subsequent turn of the game of roulette according to any selectable one of the stored wagering data sets by adding the desired wagers in that wagering data set to any wagers previously placed on the same turn of the game, alternatively by replacing all wagers previously placed on the same turn of the game with the desired wagers in that wagering data set.

10. Apparatus as claimed in claim 6 in which the player access facility enables the player to automatically construct a wagering template having a desired wager on a selectable primary number on a layout of the roulette wheel and an additional desired wager on a number adjacent the primary number on the layout of the roulette wheel.

11. Apparatus as claimed in claim 10 in which the player access facility enables the player to automatically construct a wagering template having additional desired wagers on each one of 2, 3, 4, 5, 6, 7, 8, 9, 10, 11, 12, 13, 14, 15 or 16 numbers, selectively, located closest to the primary number and circumferentially on one side thereof on the layout of the roulette wheel.

12. Apparatus as claimed in claim 10 in which the player access facility enables the player to automatically construct a wagering template having additional desired wagers on each one of a pair of individual numbers adjacent the primary number and on both sides thereof on the layout of the roulette wheel.

13. Apparatus as claimed in claim 12 in which the player access facility enables the player to automatically construct a wagering template having additional desired wagers on each of 2, 3, 4, 5, 6, 7, 8, 9, 10, 11, 12, 13, 14, 15 or 16 pairs of numbers, selectively, located closest to the primary number and circumferentially on both sides thereof on the layout of the roulette wheel.

14. Apparatus as claimed in claim 8 in which the player access facility displays to the player a total amount wagered for each one of a number of different desired wager types in any one of the wagering templates, the desired wager types including any one or more of odd numbers, even numbers, black numbers, red numbers, numbers 1 to 12, numbers 13 to 24, numbers 25 to 36, numbers 1 to 18, numbers 19 to 36, the first, second and third columns on a playing surface of the game of roulette, and the total amount of all wagers in the wagering template.

15. Apparatus as claimed in claim 6 in which the player access facility enables the player to amend any stored wagering data set, and to clear all data in any stored wagering data set.

16. Apparatus as claimed in claim 1 in which the at least one additional number is adjacent the primary number on the layout of the roulette wheel.

17. A method of operating a gaming server and a player access facility, the player access facility being remote from the gaming server and communicable with the gaming server via a communication network, the gaming server being programmed to regulate a game of roulette, the player access facility being programmed to display a simulation of a roulette wheel in the game of roulette, the method comprising:

receiving an initial instruction from a player of the game to place an initial wager on a primary number in a turn of the game;

receiving an additional instruction from the player; and in response to the additional instruction, automatically placing at least one additional wager on at least one additional number in the turn of the game, wherein the at least one additional number is based on a location of the primary number on a layout of the roulette wheel.

18. The method of claim 17, wherein the at least one additional number is adjacent the primary number on the layout of the roulette wheel.

19. The method of claim 17, wherein the at least one additional number includes a pair of numbers adjacent the primary number and on both sides thereof on the layout of the roulette wheel.

20. The method of claim 17, wherein the at least one additional number includes one of 2, 3, 4, 5, 6, 7, 8, 9, 10, 11, 12, 13, 14, 15 or 16 numbers located closest to the primary number and circumferentially on one side thereof on the layout of the roulette wheel.

21. The method of claim 17, wherein the at least one additional number includes a pair of 2, 3, 4, 5, 6, 7, 8, 9, 10, 11, 12, 13, 14, 15 or 16 numbers located closest to the primary individual number and circumferentially on both sides thereof on the layout of the roulette wheel.

22. The method of claim 17, wherein each additional wager is the same size as the initial wager.

23. A method of operating a gaming server and a player access facility, the player access facility being remote from the gaming server and communicable with the gaming server via a communication network, the gaming server being programmed to regulate a game of roulette, the player access facility being programmed to display a simulation of a roulette wheel in the game of roulette, the method comprising:

the player constructing at least one player-defined wagering template relating to a number of desired wagers to be placed on a turn of the game of roulette; and the player access facility storing a wagering data set representative of the at least one player-defined wagering template.

24. The method of claim 23, further comprising:

the player access facility storing a plurality of different wagering data sets representative of different player-defined wagering templates.

25. The method of claim 23, wherein each desired wager in the at least one player-defined wagering template relates to a type of wager to be placed on the turn of the game of roulette, and a corresponding size of the wager.

26. The method of claim 25, further comprising:

submitting the desired wagers on a subsequent turn of the game of roulette according to any selectable one of the stored wagering data sets by adding the desired wagers in that wagering data set to any wagers previously placed on the same turn of the game, alternatively by replacing all wagers previously placed on the same turn of the game with the desired wagers in that wagering data set.

27. The method of claim 23, further comprising:

automatically constructing a wagering template having a desired wager on a selected primary number on a layout of the roulette wheel and at least one additional desired wager on at least one number adjacent the primary number on the layout of the roulette wheel.

28. The method of claim 27, wherein the at least one additional desired wager comprises additional wagers on each one of 2, 3, 4, 5, 6, 7, 8, 9, 10, 11, 12, 13, 14, 15 or 16 numbers, selectively, located closest to the primary number and circumferentially on one side thereof on the layout of the roulette wheel.

29. The method of claim 27, wherein the at least one additional desired wager comprises additional wagers on each one of a pair of individual numbers adjacent the primary number and on both sides thereof on the layout of the roulette wheel.

30. The method of claim 27, wherein the at least one additional desired wager comprises additional wagers on each of 2, 3, 4, 5, 6, 7, 8, 9, 10, 11, 12, 13, 14, 15 or 16 pairs of numbers, selectively, located closest to the primary number and circumferentially on both sides thereof on the layout of the roulette wheel.

31. The method of claim 23, further comprising:

displaying total amounts wagered for each one of a number of different desired wager types in any one of the wagering templates, the desired wager types including any one or more of odd numbers, even numbers, black numbers, red numbers, numbers 1 to 12, numbers 13 to 24, numbers 25 to 36, numbers 1 to 18, numbers 19 to 36, the first, second and third columns on a playing surface of the game of roulette, and the total amount of all wagers in the wagering template.

32. The method of claim 23, further comprising:

amending any stored wagering data set.

33. The method of claim 23, further comprising: clearing all data in any stored wagering data set.

* * * * *